US006258201B1

(12) United States Patent
Krech

(10) Patent No.: US 6,258,201 B1
(45) Date of Patent: Jul. 10, 2001

(54) METHOD OF MAKING ARTICLES IN SHEET FORM, PARTICULARLY ABRASIVE ARTICLES

(75) Inventor: John E. Krech, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/298,277

(22) Filed: Apr. 23, 1999

Related U.S. Application Data

(62) Division of application No. 08/896,091, filed on Jul. 17, 1997, now Pat. No. 6,024,824.

(51) Int. Cl.[7] ..... B05D 1/10; B29C 39/10

(52) U.S. Cl. ..... 156/279; 156/303.1; 264/131; 427/180; 427/446

(58) Field of Search ..... 156/278, 279, 156/303.1; 264/DIG. 65, 131; 239/79, 80, 85, 568, 597; 427/452, 453, 201, 222, 316, 322, 180, 446; 51/295, 293, 307, 308, 309

(56) References Cited

U.S. PATENT DOCUMENTS

| | | | |
|---|---|---|---|
| 2,375,584 | | 5/1945 | Ramey . |
| 2,411,724 | | 11/1946 | Hill . |
| 2,712,987 | | 7/1955 | Storrs et al. . |
| 2,741,508 | * | 4/1956 | Marantz ..... 239/81 |
| 2,899,288 | | 8/1959 | Barclay . |
| 3,036,928 | | 5/1962 | Poole . |
| 3,190,178 | | 6/1965 | McKenzie . |
| 3,664,242 | | 5/1972 | Harrington et al. . |
| 3,813,231 | | 5/1974 | Gilbert et al. . |
| 3,914,468 | | 10/1975 | Condon et al. . |
| 4,031,048 | | 6/1977 | Holmen et al. . |
| 4,058,641 | | 11/1977 | Hnojewyj . |
| 4,192,460 | | 3/1980 | Matsuo . |
| 4,240,807 | | 12/1980 | Kronzer . |
| 4,311,489 | | 1/1982 | Kressner . |
| 4,388,373 | | 6/1983 | Longo et al. . |
| 4,652,275 | | 3/1987 | Bloecher et al. . |
| 4,799,939 | | 1/1989 | Bloecher et al. . |
| 4,836,447 | | 6/1989 | Browning . |
| 4,997,461 | | 3/1991 | Markhoff-Matheny et al. . |
| 5,011,508 | | 4/1991 | Wald et al. . |
| 5,039,311 | | 8/1991 | Bloecher . |

(List continued on next page.)

FOREIGN PATENT DOCUMENTS

| | | |
|---|---|---|
| 326 948 B1 | 8/1989 | (EP) . |
| 713 730 A2 | 5/1996 | (EP) . |
| 7-4768 | 1/1985 | (JP) . |
| 327268 | 6/1972 | (RU) . |
| WO 97/21536 | 6/1997 | (WO) . |
| WO 97/25185 | 7/1997 | (WO) . |
| WO 97/37772 | 10/1997 | (WO) . |

OTHER PUBLICATIONS

Beardsley et al., PCT Patent Application No. PCT/US96/06276, entitled "Method and Apparatus for Manufacturing Abrasive Articles", filed May 3, 1996.

*Primary Examiner*—Leo B. Tentoni
(74) *Attorney, Agent, or Firm*—Scott A. Bardell

(57) ABSTRACT

The present invention provides a method of making sheet articles, for example, abrasive articles, retroreflective articles (such as traffic signs), pavement marking articles, or traction or non-skid articles. The method includes passing particles through a thermal sprayer to heat the particles and impinging the heated particles into a polymeric sheet so that the particles are at least partially embedded in the polymeric sheet. Preferably, the polymeric sheet is heated before impingement of the heated particles. One preferred method of softening the sheet is by a thermal sprayer that is used to heat the particles. A preferred thermal sprayer is a flame sprayer having a nozzle for emitting a flame, where the nozzle has a cross-web width and a downweb thickness, the width being substantially greater than the thickness.

5 Claims, 4 Drawing Sheets

U.S. PATENT DOCUMENTS

| | | |
|---|---|---|
| 5,090,968 | 2/1992 | Pellow . |
| 5,131,926 | 7/1992 | Rostoker et al. . |
| 5,201,916 | 4/1993 | Berg et al. . |
| 5,213,591 | 5/1993 | Celikkaya et al. . |
| 5,297,733 | 3/1994 | Burks et al. . |
| 5,316,812 | 5/1994 | Stout et al. . |
| 5,474,583 | 12/1995 | Celikkaya . |
| 5,500,273 | 3/1996 | Holmes et al. . |
| 5,505,747 | 4/1996 | Chesley et al. . |
| 5,612,081 | 3/1997 | Orr et al. . |

* cited by examiner

METHOD OF MAKING ARTICLES IN SHEET FORM, PARTICULARLY ABRASIVE ARTICLES

CROSS REFERENCE TO RELATED APPLICATION

This application is a divisional of U.S. patent application Ser. No. 08/896,091, filed Jul. 17, 1997, now U.S. Pat. No. 6,024,824.

BACKGROUND

The present invention generally relates to a method of making an article, particularly an abrasive article, comprising embedding heating particles into a polymeric sheet substrate using a flame or thermal sprayer.

There are many products which generally comprise a sheet of polymeric material with particulate material either within or on the surface of the sheet. For example, certain types of coated abrasive articles have abrasive particles bonded to a backing sheet using a polymeric binder.

Coated abrasive articles are conventionally produced by a multi-step coating process which typically involves applying a first polymeric binder or adhesive (known as a make coat) to a backing sheet or substrate; depositing abrasive particles on the make coat; drying and/or curing the make coat; and optionally, applying a second polymeric binder or adhesive (known as a size coating) to further aid the bond or adhesion of the abrasive particles to the sheet. Common coating processes are comparably slow principally because of long drying and/or curing times. In addition, such processes typically involve the use of organic solvents in the binders or adhesives, the removal and disposal of which must be carefully controlled to reduce the risk of pollution and damage to the environment.

As an alternative to the conventional coating process described above, U.S. Pat. No. 2,712,987 (Storrs et al.) reports a process of making an abrasive belt by softening a nylon substrate with a suitable solvent, and then distributing abrasive particles over the softened surface. The particles become embedded by gravity in the softened surface, after which any remaining solvent is evaporated and the nylon is hardened. U.S. Pat. No. 2,899,288 (Barclay) also reports a process for making an abrasive product in which a thermoplastic backing sheet is softened by heat and then abrasive particles are spread over the softened surface and pressed into the sheet by nip rollers. Further, U.S. Pat. No. 2,411,724 (Hill) reports a method for making an endless tubular abrasive element for a tool such as a rasp or file. A thermoplastic or thermosetting polymer is extruded to form a backing and, while the backing is hot, abrasive particles are blown into the backing which is then solidified. U.S. Pat. No. 3,813,231 (Gilbert et al.) reports a process where the abrasive particles are distributed over the surface of a polymeric film, which is then heated in a platen press to bond the particles to the film. U.S. Pat. No. 4,240,807 (Kronzer) reports a process where a paper substrate is coated with a heat-activatable binder which is softened by heat, and then abrasive particles are distributed over the binder and allowed to sink into the coated paper substrate. These reported processes, although generally free of solvents, are time and energy consuming and provide poor or inadequate adhesion of the abrasive particles to the polymeric backing. In an alternative process, U.S. patent application Ser. No. 08/583,990 (Sanders et al., filed Jan. 11, 1996) now U.S. Pat. No. 5,681,361 and PCT patent application Ser. No. US96/06276 (Beardsley et al., filed Jan. 15, 1996) report combining powdered resin and abrasive particles and then spray coating the mixture onto a lofty non-woven web.

Pavement marking materials and retroreflective articles, such as used on streets and in cross walks and on traffic signs use light reflective particles typically glass beads, bonded to or into a sheet of flexible and weather resistant sheet material. These types of articles have been made in many of the same processes as used to make abrasive articles except that light reflective particles are adhered to the substrate.

What is needed in the abrasives field, and other fields having similar constructions of attaching or fixing particles on a sheet product, is a method of producing the product quickly, economically, with minimal energy consumption, and without the use of solvents.

SUMMARY OF INVENTION

One embodiment of the present invention is a method of making a sheet article, comprising the steps of passing particles through a thermal sprayer to heat the particles and impinging the heated particles into a polymeric sheet so that the particles are at least partially embedded in the polymeric sheet.

Preferably, the polymeric sheet is heated before impingement of the heated particles. One preferred method of softening the sheet is by the heat from the thermal sprayer.

The resulting sheet article may be, for example, an abrasive article, a retroreflective article (such as retroreflective traffic signs), a pavement marking article, or a traction or non-skid article.

Another embodiment of the present invention is an apparatus for making a sheet article having a means for contacting a particle with heat from the thermal sprayer to heat the particle, and a means for impinging the heated particle into a polymeric sheet. A preferred apparatus is a flame sprayer comprising an elongated nozzle for emitting a flame, wherein the nozzle has a cross-web width and a downweb thickness, the width being substantially greater than the thickness and wherein the nozzle is adapted to thermally heat particles to be impinged into a polymeric sheet.

DETAILED DESCRIPTION

Figure 1:
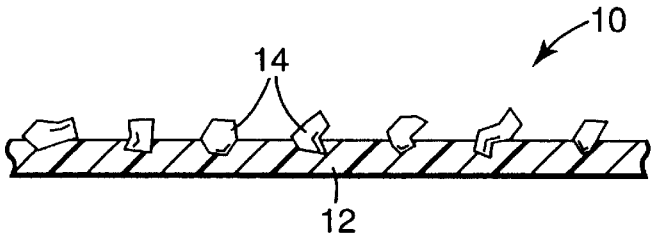
FIG. 1 is a cross-section of one embodiment of an article made according to the present invention.
Figure 2:
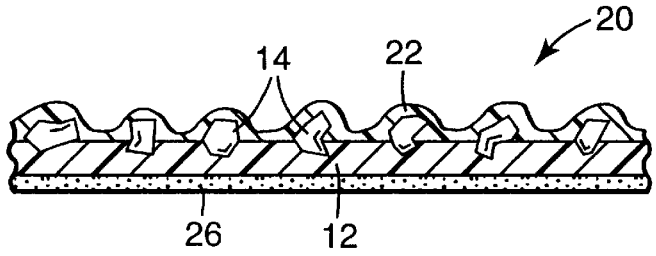
FIG. 2 is a cross-section of an alternate embodiment of an article made according to the present invention.

In one embodiment, the present invention provides a method of making a polymeric sheet or polymeric material having particles therein. FIG. 1 illustrates article 10 comprising polymeric sheet or substrate 12 having particles 14 embedded therein. Particles 14 are embedded in substrate 12 while particles 14 are hot and preferably while substrate 12 is at least partially molten or softened. FIG. 2 illustrates another embodiment of the invention, article 20.

Figure 4:
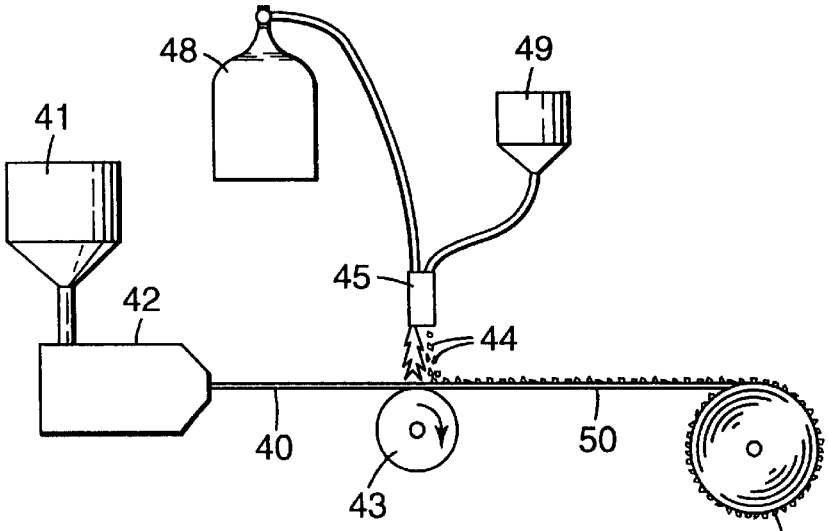
FIG. 4 is a schematic of a process of the present invention.

FIG. 4 is a schematic of one embodiment of the process of the present invention. Polymeric resin, stored in hopper 41 is fed into extruder 42 which then produces polymeric sheet 40. After polymeric sheet 40 is formed through extrusion, it passes by flame sprayer 45 where it is at least partially softened. Particles 44, stored in hopper 49, are fed to flame sprayer 45 which heats particles 44 and. impinges them into substrate 40. In this embodiment, substrate 40 is in direct contact with casting roll 43 during the time that heated particles 44 are being impinged into substrate 40. Resulting article 50 is collected on take-up roll 52. Flame sprayer 45 is fueled by combustion gas fed from source 48.

Polymeric Sheet Substrate

A polymeric sheet or polymeric substrate which may be used in the method of the present invention generally has properties appropriate for the intended use of a resulting article. For example, if an abrasive article is desired, the polymer sheet or substrate should have a relatively high melt temperature, be heat and water resistant, and have a degree of toughness appropriate to its use. If a street marking article is desired, the polymer should be resistant to both ultraviolet light and environmental conditions (such as freeze/thaw cycles).

The polymeric sheet may be either a thermoplastic, thermoplastic elastomer, thermosetting material, or combinations of these materials. If combined, it is preferred that the mixture be homogenous. However, in some instances, it may be preferred that the polymeric sheet have areas of different materials, depending on the desired properties. Preferably, the polymeric material is either a thermoplastic or thermoplastic elastomer. Suitable thermoplastic materials include polyethylene, polyesters, polystyrenes, polycarbonates, polypropylene, polyamides, polyurethanes, or related mixtures. Particularly useful thermoplastic polymeric materials include "SURLYN", an ionically crosslinked polymer derived from ethylene/methacrylic acid copolymers and "NUCREL", an ethylene acid copolymer both commercially available from DuPont, as well as "3365" polypropylene commercially available from Fina Oil & Chemical. Examples of suitable thermoset materials include phenolic resins, rubbers, polyvinyl chlorides, nylon, acrylics and acetates.

The polymeric sheet or substrate is preferably in the form of a sheet or web, that is, having a width and length significantly greater than the thickness of the substrate. The sheet is generally 25 micrometers to 2.5 millimeters (1 mil to 100 mils) thick, and may range in width from about 3 cm to 1 meter or greater. The sheet can be a single layer of polymer or multilayered. In some situations, it may be desired to use a polymeric web comprising fibers, such as a lofty nonwoven web. In other situations, it may be desired to add reinforcing fibers, e.g., fine thread-like pieces with an aspect ratio of at least about 100:1, to the polymeric web. Preferably, such reinforcing fibers or fibrous material is distributed throughout the polymeric web.

These polymeric sheets are well known and may be made by many procedures. For example, a suitable sheet or web may be extruded directly before impingement of the particles. Any suitable extruder may be used to provide the polymeric sheet or substrate. Examples of extruders include twin screw and single screw extruders. The barrel of the extruder may optionally be rifled. The diameter of the barrel may vary within the range from about 25 mm to 30 cm, depending on the desired production output. Likewise, the length to diameter ratio for the screw of the extruder depends on the desired output and on the types of polymer to be extruded. Suitable length to diameter ratios typically range from 24:1 to 48:1. Typical screw speeds are in a range of from 5 rpm to 550 rpm. In some instances, it may be desired to add a processing agent or lubricant to the polymer before extruding to help in the extrusion process. Extrusion of the polymeric sheet directly prior to impingement of the heated particles is generally preferred because the polymer may still be in a softened, or even semi-molten state, at the impingement point which improves the embedding of the particles.

Another option for providing the sheet is to form the polymeric sheet substrate before embedding the particles material. Commercially available preformed polymeric films may be used in the method of the present invention in the same manner as if the polymeric film was being extruded immediately prior to impingement of the heated particles. Preformed films may be a layered material, i.e., having multiple layers. For example, a polymeric material may be layered with a second polymer layer or with a conventional backing such as paper, cloth, or metal foil. It is feasible to use multi-layered films having as many as 30 and more layers. The various layers may be laminated together or may be co-extruded. The paper, cloth, or any other layer may be treated with a resinous adhesive or other primer or treatment to modify the physical properties of the layer.

If a preformed film is passed by a thermal sprayer, the provided heat of the thermal sprayer may also soften the film material in addition to heating of the particles. Optionally, the preformed polymeric film may be softened, for example by heated nip rolls or an oven, prior to impingement of the particles.

In some embodiments, it may be desired to provide a resin, adhesive or other primer or coating for example ethylene acrylic acid or any other suitable primer, on the polymeric web prior to impingement of the particles.

Additives

Various materials may be added to the polymeric sheet or substrate. These additives may be loaded into the extruder so that the additive is homogeneous throughout the polymer. Useful additives include, for example, pigments, dyes, reinforcing materials, toughening agents, coupling agents, antistatic compounds (for example carbon black or humectants), anti-oxidants, polymer processing additives, plasticizers, fillers (including grinding aids which are well known in the abrasives art), stabilizers, expanding agents, suspending agents, initiators, photosensitizers, lubricants, wetting agents, surfactants, foaming agents and fire retardants. The amounts of these additives are selected to provide the properties desired.

Toughening agents may be added to the polymer to increase the impact resistance of the polymer. Examples of toughening materials include rubber-type polymers and plasticizers. Specific examples of rubber-type toughening materials include toluene sulfonamide derivatives, styrene butadiene copolymers polyether backbone polyamide commercially available from Atochem under the trade designation "PEBAX", rubber grafted onto nylon commercially available from DuPont under the trade designation "ZYTEL FN", and a triblock polymer of styrene-ethylene butylene-styrene commercially available from Shell Chemical Co. under the trade designation "KRATON 1901X". Typically a polymer will contain between about 1% to 30% toughener, but this range may vary depending upon the particular toughening agent employed.

Examples of plasticizers include polyvinyl chloride, dibutyl phthalate, alkyl benzyl phthalate, polyvinyl acetate, polyvinyl alcohol, cellulose esters, phthalate, silicone oils, adipate and sebacate esters, polyols, polyol derivatives tricresyl phosphate, and castor oil.

Coupling agents may be added to the polymer to increase the adhesion of the polymer to the particles. Specific examples of useful coupling agents include "FUSABOND" from DuPont and "UNITE" from Artistech Chemical Corp., Pittsburgh, Pa.

Thermal Sprayer

One embodiment of the present invention heats particles with a thermal sprayer and then impinges the heated or hot particles into the polymeric sheet. Optionally, and preferably, the polymeric sheet is softened, preferably to the point where it is at least partially molten. The polymeric sheet is generally softened by thermal energy or radiation. Examples of suitable thermal energy sources include ovens and furnaces, heated nip or calendar rolls, flames, infrared waves, microwaves, and radio frequency waves. Examples of radiation sources include electron beam, ultraviolet and visible light. The preferred method to soften the polymeric sheet is to use the heat of the same flame sprayer used for impingement of the particles.

Flame sprayers known in the art are generally not designed for use in sheet or web coating applications. Most commercial flame sprayers are designed to coat small pieces, e.g., individual parts, via hand held or robot controlled spray guns. Examples of typical uses for flame spray guns include powder painting farm machinery and construction equipment, and retrofit machine parts and components.

Figure 3A:
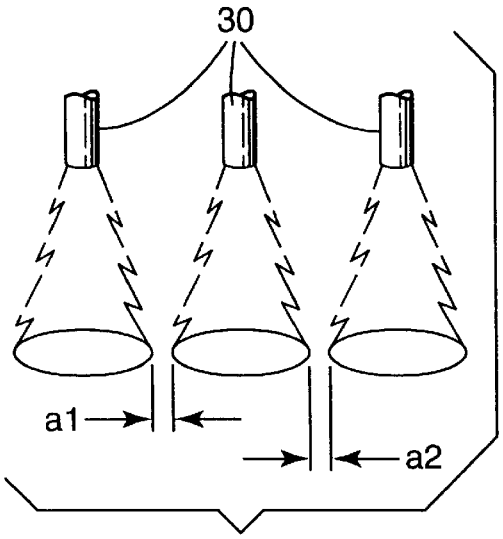
FIGS. 3*a* and 3*b* are schematics of a plurality of conventional flame sprayers.
Figure 3B:
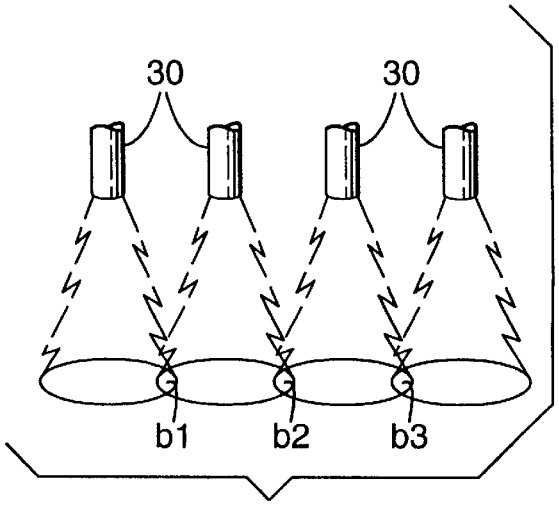

Typically, a conventional flame sprayer has a single nozzle which can coat an area approximately one to four inches wide (approximately 2.5 to 10 cm). Because of this narrow coverage width, numerous nozzles would therefore be required to span a wide web. The use of multiple nozzles can produce a very non-uniform temperature gradient across the substrate being heated. For example, FIGS. 3*a* and 3*b* show methods used to provide a wide coating area using multiple conventional flame sprayers. In both FIGS. 3*a* and 3*b*, multiple conventional flame sprayers are arranged to cover a set width. The arrangement in FIG. 3*a* utilizes three flame sprayers and the arrangement in FIG. 3*b* utilizes four flame sprayers to provide coverage over the width. As illustrated by both arrangements, the temperature gradient across a set width is non-uniform. In FIG. 3*a,* areas "a1" and "a2" receive either less heat or even no heat from the multiple flame sprayers and resultant heated particles than the areas thoroughly covered by the spray from these nozzles. In FIG. 3*b,* areas "b1", "b2" and "b3" receive more heat than the areas with no overlap. In areas such as "a1", "a2", "b1", "b2" and "b3", the density or coverage of resultant heated particles will not be uniform in the areas directly under the spray because of the inconsistent heating. Areas "a1" and "a2" may be completely devoid of particles after the spraying processes, because those areas are not within the spray pattern of the flame sprayers. Alternately, areas "b1", "b2", and "b3" may have too great a particle density, or even possibly, the heat from the four flame sprayers and heated particles could be so great that holes are melted in the polymeric web.

A thermal sprayer of the present invention comprises a wide elongate nozzle having an equal amount of energy (joules or BTU) output across its width. The width of the nozzle (that is, in the cross-web direction), can generally be about 2.5 cm to 1 meter, preferably about 45 cm to 90 cm, although a Nozzle 6 meters in width could easily be constructed and used. It is preferable that the nozzle span the entire desired width of the web substrate. Otherwise, several nozzles may be arranged across the width of the web, however this should generally be avoided because the same problems as shown in FIGS. 3*a* and 3*b* may occur. The thickness of the nozzle (that is, the width of the nozzle in the down-web direction) at the point of exit of the flame, can generally be 1 mm to at least 5 cm, preferably 0.5 cm to 3 cm. The nozzle is generically described as a slot or a ribbon, i.e., having a width (i.e., cross web) substantially greater than its thickness (i.e., downweb). It is preferred that the width of the nozzle is at least 1.5 times greater than the thickness, preferably at least 10 times greater, more preferably at least 50 times greater.

A thermal sprayer or slot burner differs from a conventional flame sprayer only in that for the thermal sprayer or slot burner the flame itself does not emit from the nozzle of the sprayer, but rather, gas heated by a flame source emits. The resulting properties and mode of operation of a thermal sprayer or slot burner is very similar to those of a flame sprayer, and can be considered to be essentially equivalent. An example of a commercial slot burner is available from Selas Corporation of America (Dresher, Pa.) under the designation "Superheat Slot Burner".

Figure 5A:
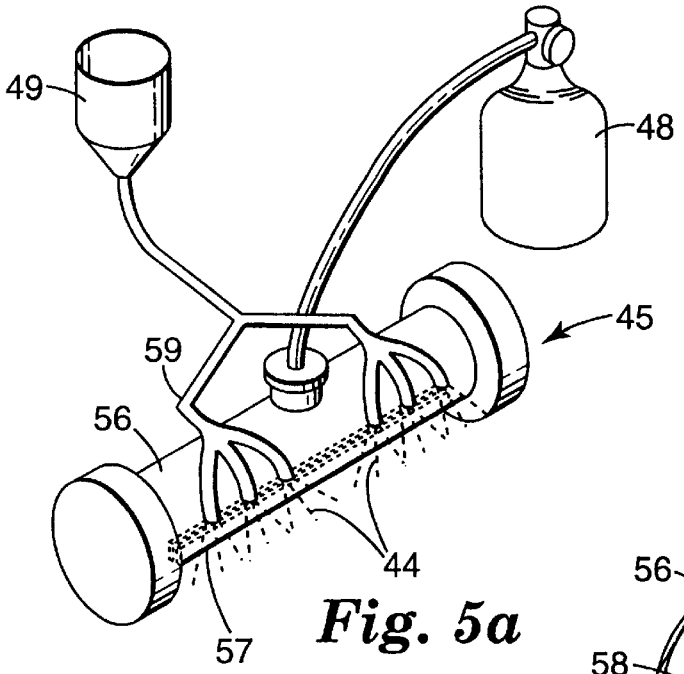
FIGS. 5*a* and 5*b* are isometric and cross-sectional views of one type of flame sprayer apparatus of the present invention.
Figure 5B:
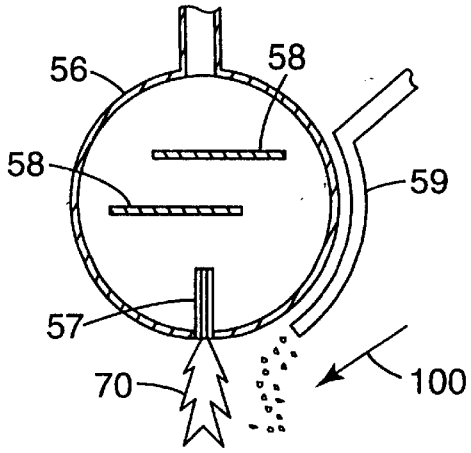
Figure 6A:
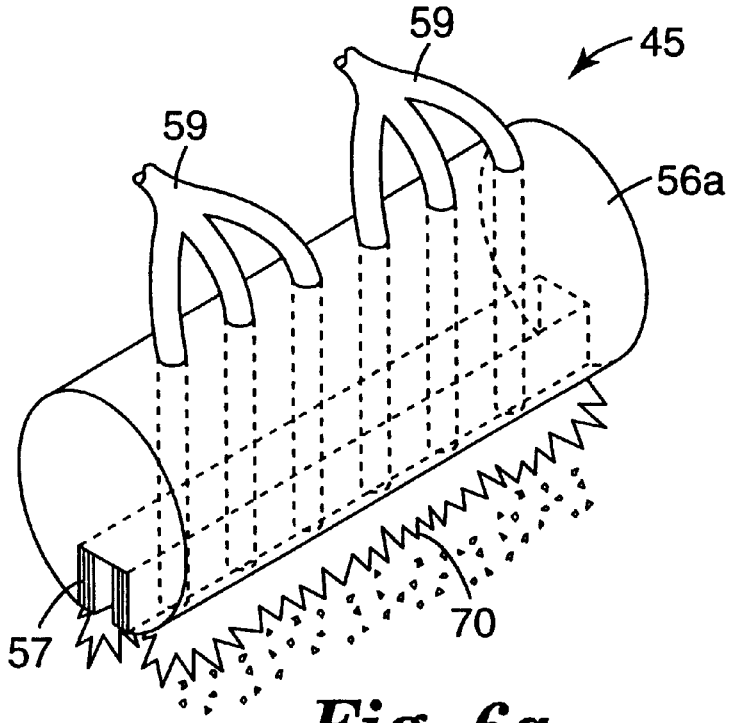
FIGS. 6*a* and 6*b* are isometric and cross-sectional views of another type of flame sprayer appartus of the present invention.

FIGS. 5*a* and 5*b* show preferred flame sprayer 45 of the current invention. Flame sprayer 45 has elongate nozzle 56 which is generally hollow throughout and has a pattern of holes created by a metal ribbon through which flame 70 emits. A suitable nozzle is a ribbon burner commercially available from Flynn Burner Corporation. Particles 44 are impinged from tubes 59 which can be adjacent yet outside of nozzle 56 as shown in FIG. 5*a*. Alternatively, tubes 59 can pass through the interior of nozzle 56*a* as shown in FIG. 6*a*. FIG. 5*b* is a schematic of the cross section of nozzle 56 fitted with ribbon burner 57 and baffles 58. Flame 70 is shown emitting from nozzle 56.

The flame emits from generally the entire width of the nozzle. Tubes, generally spaced equally along the width of the nozzle, carry the particles which are eventually impinged into the heated polymer web. The tubes are typically located adjacent the nozzle outside of the area of the flame (i.e., just on the outer edge of the nozzle). Alternatively, the tubes may pass through the nozzle itself so that the particles are ejected from within the area of the flame. Preferably, the tubes are spaced equidistant down the width of the nozzle with approximately 2.54 cm from the center of one tube to the center of the next tube. The tube cross-sectional area may be any known shape (i.e., square, circle, ellipse, rectangle, etc.) but the cross-sectional area is generally circular with the diameter of the tubes generally about 0.6 cm but alternatively may be between about 0.08 to 5 cm. The tubes are preferably copper tubes, but may be made of any material which will withstand the heat of the flame, for example, stainless steel, ceramic lined tubes, and high temperature plastic tubes (Teflon™ and silicone).

The flame of the sprayer is fed by a combustion gas including air, oxygen, nitrogen, and/or other gas blends provided by source 48. The temperature of the flame is dictated by the combustion gas composition (i.e., ratios of gases such as propane, oxygen, natural gas, and/or air). Examples of combustion gases include, but are not limited to, methane, propane, butane, and natural gas. The temperature emitting from the nozzle is preferably within the range of 1200 to 2880° C. (2200 to 5200° F.). Heat output from the flame is generally dictated by the flow rate of the feed gas. Traditional flame sprayers are designed to consume a great amount of energy, on the order of 20,770–83,100 kJ/cm (50,000–200,000 BTU/inch) of coating area. Typically, for the flame sprayer of the present invention, amounts of energy of about 519 to 12,460 kJ/cm (1250 to 30,000

BTU/in) are used. It is desired that there are minimal fluctuations in temperature and amounts of energy (joules or BTUs) across the width.

Figure 6B:
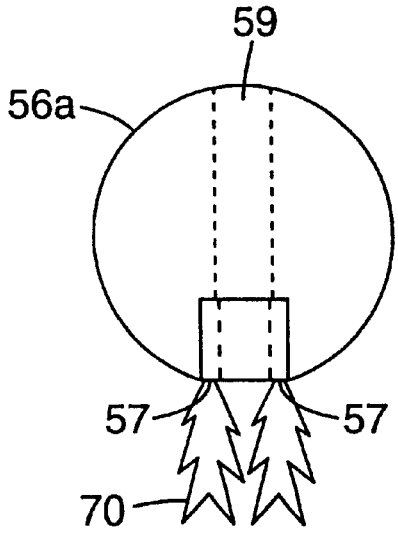

As illustrated in FIGS. 5*a* and 6*b,* particles 44 are passed either in close proximity to or through flame 70. FIG. 5*b* depicts how the particulate stream (denoted as vector 100) and flame 70 intersect. The angle between the particulate stream along vector 100 and flame 70 may vary from between 0° to 180°, but is preferably between about 10° to 60°. The angle between the particulate stream and the flame is measured as the inclusive angle between particulate stream vector and flame when viewed from the perspective of nozzle 56. FIG. 5*b* shows an angle of approximately 60° between the particulate stream 100 and flame 70. An angle of 0° would exist when the particulate stream and the flame are parallel and in the same direction; an angle of 90° would exist when the particulate stream is perpendicular to the flame; and an angle of 180° would exist when the particulate stream is parallel to the flame but in the opposite direction. When using an angle of 180° an external force, such as for example gravity or a magnetic or electrostatic field, would also need to be used to orient the particles toward the heated polymeric sheet. Particles 44 are heated by flame 70 as they pass either through or in close proximity to the flame. The resulting temperature of particles 44 can be adjusted by altering the angle of intersection between the particulate stream and the flame to change the residence time in the flame. Additionally, the initial temperature of the particles and the temperature of the flame will impact the resulting temperature of the particles.

The amount of heating and softening of the polymeric sheet by the flame may be controlled, for example, by the distance between the polymeric sheet and the nozzle, the width of the nozzle, optional multiple nozzles, by the temperature and amount of energy (joules or BTUs) produced by the flame, and by the temperature of the particles. It may also be controlled by the casting or back-up roll used (shown as casting roll 43 in FIG. 4), the line speed of the process, and the thickness of the polymeric web.

A preferred flame sprayer of the present invention consumes significantly less energy than a conventional flame sprayer because of the continuous, non-overlapping method which provides complete coverage across the web. Most conventional flame sprayers are designed to heat any particles which pass through its flame to at least 1000° C., generally several thousand degrees. The flame sprayer of the present invention is designed to heat the particles to only several hundred degrees, generally 93° C. (200° F.) to 316° C. (600° F.), however, colder and hotter temperatures can be obtained by, for example, increasing particle speed and increasing the energy of the flame (joule/cm or BTU/inch), respectively. The flame sprayer of the present invention generally consumes approximately 85%, generally 90%, and preferably 95% less energy (or fuel) to produce the same particle temperature. Additionally, traditional flame sprayers are designed to consume a great amount of energy, on the order of 41,535 kilojoules per cm (100,000 BTU per inch) of coating area. For example, a conventional flame sprayer, available from Metco Corp. under the trade designation "SP-II" utilizes approximately 314 $cm^3$/sec (40 SCFH) propane fuel gas for a 1 inch coating area, which is 3773 $cm^3$/sec (480 SCFH) for a 12 inch wide area, to produce a particle temperature of about 90° to 160° C. Another conventional flame sprayer, designed specifically for powder coating, commercially available from Plastic Flamecoat Systems under the trade designation "124 POWDER MASTER" utilizes approximately 400 $cm^3$/sec (51 SCFH) for a 1 inch coating area, or 4837 $cm^3$/sec (617 SCFH) for a 12 inch wide spray area. Conversely, the flame sprayer of the present invention utilizes approximately 196 $cm^3$/sec (25 SCFH) for a 12 inch width to obtain the same particle temperature.

The nozzle of the thermal sprayer may optionally be cooled with jets of air or by water or other heat transfer fluids. Cooling of the nozzle helps to minimize the amount of material which may become adhered to the nozzle surface. In some embodiments, particularly where a low melting particle (for example, phenolic resin) is being used, cooling of the nozzle is especially useful for minimizing the build-up of resin on the nozzle.

A multiplicity of wide nozzles may be used in series in the down-web direction of the polymeric web substrate. Several rows of nozzles can be used to apply different types of particles. For example, when making a high performance abrasive article, the first nozzle could spray a layer of brown aluminum oxide particles, a second nozzle could spray ceramic alumina abrasive particles, and then a third nozzle could overspray a polymeric size coating. Several rows of nozzles could alternately be used to increase to coating speed by applying several layers of the same particulate. Additional nozzles could also be used to preheat or flame-treat the polymeric web substrate prior to impingement of the particles.

Particles

Examples of usable particles for use in the present invention include, but are not limited to, abrasive particles, reflective (or retroreflective) particles, and friction particles. The average size of the particles is generally 5 to 6550 micrometers, preferably 25 to 500 micrometers. In particular, abrasive particle sizes useful in the method of the present invention include 7 to 6545 micrometers (approximately ANSI Grade 900 to 4). Examples of abrasive particles include fused aluminum oxide (including fused alumina-zirconia), ceramic aluminum oxide, silicon carbide (including green silicon carbide), garnet, diamond, cubic boron nitride, boron carbide, chromia, ceria, and combinations thereof. Different types of abrasive particles may be blended or mixed prior to being fed through the thermal sprayer, though it is recommended that the different particles be comparable in size for the sake of heat and mass transfer requirements. For a retroreflective material, 30 to 850 micrometer particles are particularly useful. Glass and ceramic particles such as beads and bubbles are typically used as particles in retroreflective sheet materials. Examples of particles generally used for friction surfaces include coal slag, graphite, carbon black, aluminum oxide, silicon carbide, quartz, and ceramic spheres. In some instances, metal particles may be desirable. To produce a conductive material, carbon black or graphite particles can be used.

Thermoplastic and thermosetting particles, for example polyester and nylon, and melamine formaldehyde and phenol formaldehyde, could also be used as the particle, but care should be taken so that the particles retain their integrity when being applied by the thermal sprayer. These polymeric particles may include fillers in the polymer such as graphite or carbon black or any other fillers.

The particles used in the present invention may be irregular or precisely shaped. Irregularly shaped abrasive particles may be made, for example, by crushing a precursor material. Examples of shaped abrasive particles include rods (having any cross-sectional area), pyramids, and thin faced particles having polygonal faces. Shaped abrasive particles and methods of making them are described, for example, in U.S. Pat. No. 5,090,968 (Pellow) and U.S. Pat. No. 5,201,916 (Berg et al.), both of which are incorporated herein by reference for their reporting of shaped abrasive particles. Polymeric particles can be any shape either irregular or shaped (for example, cubes, spheres, discs, etc.). Spherical glass or polymeric beads are typically used for pavement marking applications.

The particles used in the present invention may be in the form of an agglomerate, i.e., multiple particles bonded together to form an agglomerate. Abrasive agglomerates are further described in U.S. Pat. No. 4,311,489 (Kressner), U.S. Pat. No. 4,652,275 (Bloecher et al.), U.S. Pat. No. 4,799,939 (Bloecher et al.), U.S. Pat. No. 5,039,311 (Bloecher), and U.S. Pat. No. 5,500,273 (Holmes et al.), all of which are incorporated herein by reference.

It is also possible to have a surface coating on the particles. Surface coatings may be used to increase the adhesion of the polymeric sheet to the particle, alter the abrading characteristics of abrasive particles, improve the processability through the thermal sprayer, or for other desired purposes. Examples of surface coatings on abrasive particles are taught, for example, in U.S. Pat. No. 4,997,461 (Markhoff-Matheny et al.), U.S. Pat. No. 5,011,508 (Wald et al.), U.S. Pat. No. 5,131,926 (Rostoker), U.S. Pat. No. 5,213,591 (Celikkaya et al.), and U.S. Pat. No. 5,474,583 (Celikkaya), all incorporated herein by reference. Coupling agents such as silanes, titanates, and zirconates are common coatings used on particles to increase their adhesion to organic materials. A particularly useful coupling agent is available from Union Carbide Corp. (Danbury, Conn.), under the trade designation "A-1100" brand silane coupling agent.

Suitable particles may be preheated prior to their passage through the thermal sprayer. Preheating of the particles may be done, for example, in a rotary kiln, tunnel oven, or standard convection oven. Alternately, heated gas (generally air) may be used as the carrier gas for the particles instead of ambient temperature air.

It is preferred that the particles, once heated by the thermal sprayer and impinged into the polymeric web, are embedded in the polymeric material at least 25% as measured by a thickness of the sheet or substrate containing imbedded particle compared to total thickness of coated sheet or substrate adjusted to include the average particle size or particles not imbedded in the sheet or substrate, more preferably at least 40%, and most preferably at least 50%. Generally, the greater the depth of penetration of the particle into the polymeric sheet, the greater the adhesion of the particle to the web. However, the greater the penetration, the less exposed area of the particle remains which can be utilized. For example, in the case of an abrasive article, the desired depth of penetration of the particle into the polymeric web is approximately 60% of the particle. An abrasive particle in an abrasive article endures significant pressures and forces during grinding and polishing operations. For anti-slip articles, such as a non-skid film for placement on stairs and steps, and for retroreflective articles, the depth of penetration acceptable can be less because of the less intensive applications, and is generally approximately 50% penetration of the particle.

Optional "Size" Coat

In some embodiments, for example an abrasive article or a slip resistant material, it may be desirable to provide a coating layer on top of the impinged embedded particles. Such a coating layer over the particles is generally known as a "size" coat. A size coat is typically applied to improve the adhesion of the particles to the sheet material, to increase wear and dirt resistance, or other desired properties. FIG. 2 illustrates another article made by the method of the present invention. Article 20 comprises particles 14 embedded in polymeric substrate 12, over which is applied size coat 22. The size coat may be applied directly over the particles after the particles have been impinged into the polymer or the size coat may be applied at a later point in time. The size coating may be the same material as the base polymeric sheet or may be a different type of material.

For example, a size coat layer may be applied to the polymeric sheet or substrate with a similar flame sprayer apparatus. The size coat may be applied by a second flame sprayer located downweb from or directly adjacent a first thermal sprayer or may be applied by the same thermal sprayer which heats and impinges the particles. It is also possible to blend or mix particles which form a size coat with other types of particles (i.e., abrasive particles, etc.) prior to being fed through the thermal sprayer, although it is recommended that the different particles are comparable in size for the sake of heat and mass transfer requirements.

Figure 7:
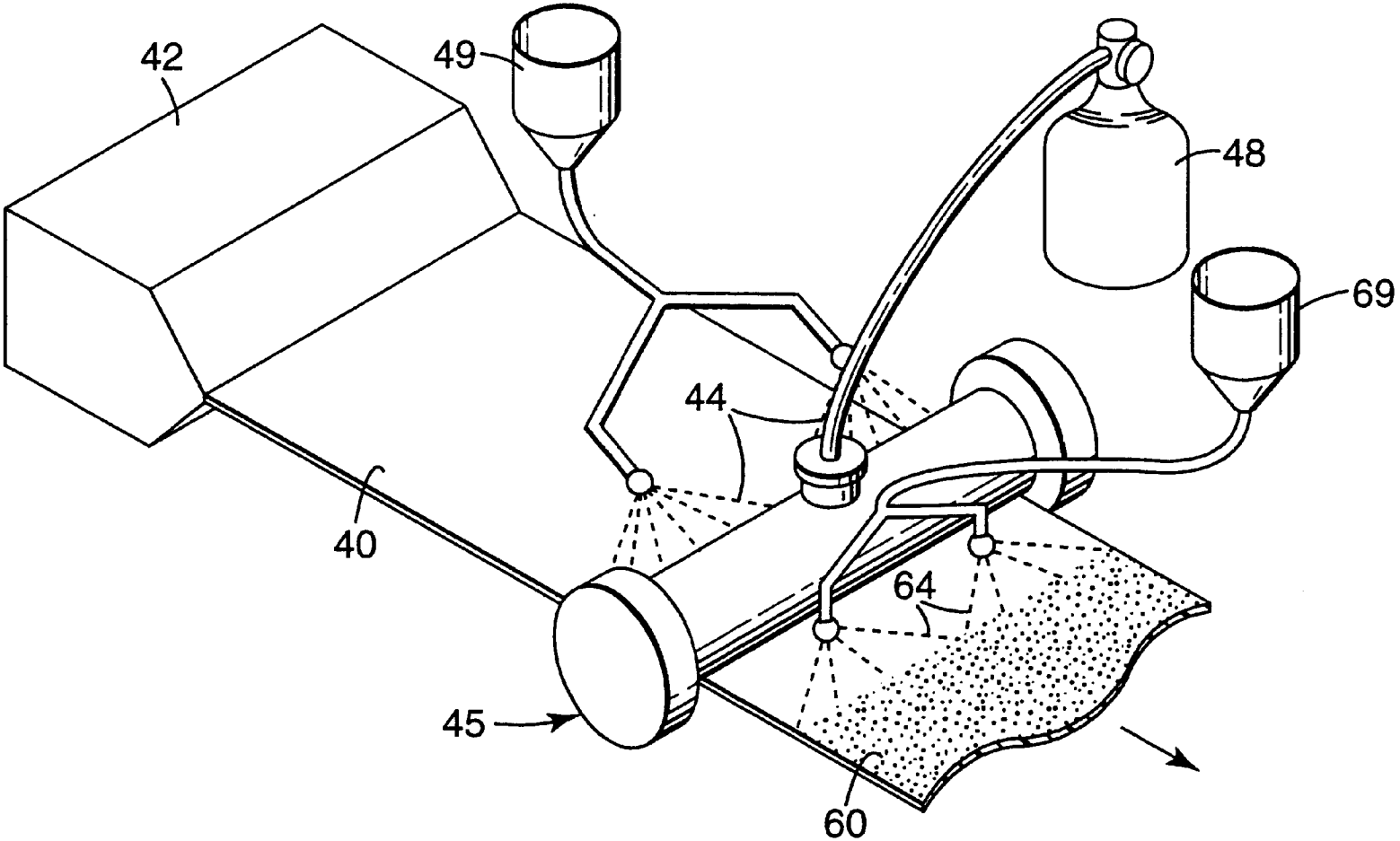
FIG. 7 is an isometric view of a process of the present invention.

FIG. 7 illustrates one embodiment of applying a size coat over an abrasive article by applying a powered resin size coat with the same flame sprayer as used to impinge the abrasive particles. Sheet substrate 40 is extruded by extruder 42. While still slightly molten, substrate 40 passes under flame sprayer 45. Immediately before the nozzle, particles 44 fed from hopper 49 are passed through a flame and heated prior to being impinged into substrate 40. Immediately after the nozzle, powdered resin particles 64 fed from hopper 69 are sprayed onto particles 44 and substrate 40. Resulting article 60 comprises substrate 40 into which are impinged particles 44, the entire construction having a size coat thereover.

Preferably, the nozzle of the flame sprayer is cooled to decrease the amount of resin which may become melted onto and adhered to the nozzles.

Examples of suitable size coat particles include, for example, polyester resin particles commercially available from Ferro Corp. under the trade designation "VEDOC" and from Reichhold Chemicals, Inc. under the trade designation "FINE-CLAD", phenolic resin particles commercially available from OxyChem under the trade designations "DUREZ" and "VARCUM", and ethylene acrylic acid particles commercially available from Sulzei-Metco under the trade designation "LTP". The size of the size coat particles is generally in the range of 10 to 350 micrometers, typically between 30 and 100, although larger and smaller particles may also be used.

The thickness of the size coating is controlled by the combination of the line speed of the polymeric web and the flow rate of the size coat particles. Factors such as particle size, particle velocity, and viscosity of the particles when melted may also have an effect on coating thickness.

Alternately, a conventional liquid size coat can be applied over the polymeric web and particles by conventional means such as a roll coater or conventional spray coater. In embodiments where coaters such as roll coaters, knife coaters, gravure coaters, and the like are used, the size coat is generally applied as a liquid.

It is also within the scope of this invention to provide two or more size coats over the particles for improved adhesion and durability. Additionally any additives, such as grinding aids, fire retardants, UV and heat protectors, IR stabilizers, and such, may be added to the size coating whether the size coating is applied with a thermal sprayer or by conventional means. In the abrasives area, a second size coat or supersize coating typically is a phenolic resin which includes either grinding aids to improve abrasive grinding performance or anti-loading agents such as stearates which decrease the amount of swarf and debris collected on the surface of the abrasive article.

An attachment system or other additional layers may be provided on the back of the article prior to, during, or after manufacture of the article (i.e., after impingement of the particles into the web). For example, a pressure sensitive adhesive (PSA) coating can be co-extruded simultaneously with the polymeric sheet. As another example, either half of an attachment system such as a hook and loop fastener system may be laminated to the polymeric sheet or substrate once the particles have been embedded therein. Alternately, the attachment system may be incorporated with the sheet substrate before the polymer is optionally softened and the particles embedded therein. For example, a sheet of hooking stems, such as any of those reported in U.S. Pat. No. 5,505,747 (Chesley et al.), may be used as the polymeric sheet or substrate. In another embodiment, FIG. 2 illustrates a pressure sensitive adhesive attachment system 26 on the back of polymeric substrate 12.

The following non-limiting examples will further illustrate the invention. All parts, percentages, ratios, etc., in the examples are by weight unless otherwise indicated.

EXAMPLES

Example 1, an abrasive article, was prepared by extruding polypropylene (commercially available from Fina Oil & Chemical of Dallas, Tex. under the trade designation "3365") into a 0.25 mm (10 mil) thick 30.5 cm (12 inch) wide web using a conventional single screw extruder at 100–130 rpm and 246° C. (475° F.). The film was cast using electrostatic pinning on a cooling roll. Approximately 10 cm after the extruder, a modified flame sprayer was positioned so it would soften the polypropylene sheet. The flame sprayer consisted of one 35.5 cm (14 inch) wide ribbon burner, commercially available from Flynn Burner Corporation, New Rochelle, N.Y., Designation No. HC-511-18, DP No. 025800. Copper particle feed tubes, 0.6 cm (0.25 inch) diameter, were spaced at 5 cm (2 inch) increments along the width of the burner. Propane gas was fed at a rate of 157 $cm^3$/sec (20 SCFH) and ambient temperature air at a rate of 3836 $cm^3$/sec (488 SCFH) in order to create the flame. The approximate temperature was 1925° C. (3500° F.).

Aluminum oxide abrasive particles (ANSI Grade 80, having an average particle size of approximately 175 micrometers) were fed through the tubing at an approximately rate of 5 meters/second and dispersed across the flame of the flame sprayer and impinged into the softened web. The speed of the web was approximately 4 meters/minute (13 ft/minute). The web was carried by idler rolls for 4.6 meters (15 feet) through ambient atmosphere to cool the web before it was wound on a take-up reel. The abrasive particles were embedded approximately 50% into the polymer.

Comparative Example A was prepared by applying a 76 micrometer (3 mil) thick coating of urethane adhesive (commercially available from Mobay Chemical under the trade designation "DESMODUR") onto a 76 micrometer (3 mil) thick polyester backing. Aluminum oxide abrasive particles (as described in Example 1), were dropped onto the adhesive, after which the adhesive was allowed to dry under ambient conditions. A size coating, consisting of the same urethane adhesive was applied and dried so that the dried thickness was approximately 63.5 micrometers (2.5 mils).

Comparative Example B was prepared by coating a 114 micrometer (4.5 mil) thick layer of ethylene acrylic acid (EAA) adhesive onto an aluminum foil backing. The polymer was softened by heating in a funnel oven at 177° C. (350° F.) for approximately 45 seconds to soften the EAA. Aluminum oxide abrasive particles (as described in Example 1) were dropped onto the adhesive and allowed to sink into the polymer. The coated backing was passed through a 45.7 meter (150 foot) long tunnel oven at a speed of 18.3 meters/min (60 ft/min), which provided a residence time of 2.5 minutes, to further embed the particles. The temperature in the oven was 210° C. (410° F.). The article was removed from the oven and allowed to cool to room temperature.

Example 1 and Comparative Examples A and B were tested for wear resistance using a Taber Abrasion Tester, Model 503, available from Taber Industries of Tonawanda, N.Y. A sample was placed on the rotating platform and a "H-18" wheel was brought into contact under a 250 gram load. The wheel contacted the sample article and "abraded" the sample. After the requisite number of cycles, the weight loss of the sample was measured. The number of cycles and the results are listed in Table 1, below.

TABLE 1

| | Ex. 1 | Comp. Ex. A | Comp. Ex. B | Ex. 1 | Comp. Ex. A | Comp. Ex. B |
|---|---|---|---|---|---|---|
| cycles | 100 | 100 | 100 | 200 | 200 | 200 |
| avg. wt. loss | 0.10 | 0.07 | 0.10 | 0.12 | 0.11 | 0.16 |
| std dev | 0.046 | 0.011 | 0.006 | 0.049 | 0.013 | 0.01 |
| No. of samples | 4 | 18 | 3 | 4 | 9 | 3 |

Example 2, a non-skid traction article, was prepared by extruding a blend of 99% by weight ethylene acid ionomer (commercially available from DuPont under the trade designation "SURLYN 1705") and 1% carbon black concentrate (50% "SURLYN 1705" and 50% carbon black by weight). (The resulting extrudate was thus 0.5% by weight carbon black). The blend was extruded to 0.38–0.64 mm (15–25 mil) thick 30.5 cm (12 inch) wide web using a conventional single screw extruder at 100–130 rpm and 246° C. (475° F.). The film was cast using a vacuum assist on the casting roll. The ionomer sheet was softened with the flame sprayer as described in Example 1.

Coal slag particles (ANSI Grade 50/70, having an average particle size of between about 215 and 300 micrometers) were embedded into the softened web and further processed as described in Example 1. The speed of the web was approximately 6–9 meters/minute (20–30 ft/min).

Example 3, a non-skid traction article, was prepared as described in Example 2, except that methane gas was fed at a rate of 394 $cm^3$sec (50 SCFH) and air at a rate of 3836 $cm^3$/sec (488 SCFH) in order to create the flame.

Example 4, an abrasive article, was prepared as described in Example 2 except 100% ionomer was extruded to 0.38–0.51 mm (15–20 mil) thick 35.6 cm (14 inch) wide.

Aluminum oxide particles (ANSI Grade 80, having an average particle size of approximately 180 micrometers) were embedded into the softened web and further processed as described in Example 2. The speed of the web was approximately 7.6 meters/minute (25 ft/min).

Example 5, an abrasive article, was prepared by extruding the ionomer of Example 4 into a 0.076–0.15 mm (3–6 mil) thick 30.5 cm (12 inch) wide film using a conventional single screw extruder at 40–70 rpm and 246° C. (475° F.). The film was cast using vacuum assist on the casting roll. The ionomer sheet was softened with the flame sprayer as described in Example 1.

Aluminum oxide particles (ANSI Grade 180, having an average particle size of approximately 86 micrometers) were embedded into the softened web and further processed as described in Example 1. The speed of the web was approximately 6–9 meters/minute (20–30 ft/min).

Example 6, a reflective pavement marking article, was prepared by extruding a yellow preblend consisting of 97% ethylene acrylic acid (commercially available from DuPont under the trade designation "NUCREL"), 1% amorphous silica, 1% titanium dioxide, and 1% yellow pigment (amine compound). The blend was extruded to 0.38–0.51 mm (15–20 mil) thick 30.5 cm (12 inch) wide film using a conventional single screw extruder at 100–130 rpm and 165° C. (330° F.). The film was cast using vacuum assist on the casting roll. The polymer sheet was softened with the flame sprayer as described in Example 1.

Glass beads (having a 1.5 refractive index) were embedded into the softened web and further processed as described in Example 1. The speed of the web was approximately 6–9 meters/minute (20–30 ft/min).

In all Examples, the particles were embedded approximately 50% into the polymer.

Various modifications and alterations of this invention will become apparent to those skilled in the art, and it should be understood that this invention is not to be limited to the illustrative embodiments set forth herein.

What is claimed is:

1. A method of using a flame sprayer to impinge heated particles into a polymeric sheet, wherein particles are heated by a flame emitting from a nozzle to form the heated particles, and wherein the nozzle has a cross-web width and a downweb thickness, the width being substantially greater than the thickness.

2. The method according to claim 1, wherein the particles pass through the flame to form the heated particles.

3. The method according to claim 2, wherein the particles pass through the nozzle from which the flame emits.

4. The method according to claim 1, wherein the particles pass in close proximity to the flame to form the heated particles.

5. The method according to claim 1, wherein the particles are present in a particulate stream positioned at an angle of approximately 60° to the flame.

* * * * *